United States Patent [19]

Whitlock

[11] 4,386,779

[45] Jun. 7, 1983

[54] GAME APPARATUS

[76] Inventor: Darrell D. Whitlock, 5171 S. Pine Dr., Jacksonville, Fla. 32207

[21] Appl. No.: 314,530

[22] Filed: Oct. 26, 1981

[51] Int. Cl.[3] ..... A63B 67/06

[52] U.S. Cl. ..... 273/336; 273/58 C; 273/319; 273/387

[58] Field of Search ..... 273/336, 319, 320, 321, 273/329, 330, 331, 332, 333, 334, 335, 26 E, 26 EA, 196, 197 R, 197 A, 198, 200 R, 200 A, 200 B, 208, 58 C, 411, 393, 387

[56] References Cited

U.S. PATENT DOCUMENTS

| | | | |
|---|---|---|---|
| 1,230,503 | 6/1917 | Miller | 273/336 |
| 1,527,716 | 2/1925 | Tippen et al. | 273/198 |
| 2,520,392 | 8/1950 | Flenghi | 273/393 |
| 3,428,319 | 2/1969 | Engle | 273/393 |
| 3,948,521 | 4/1976 | Warren | 273/393 |

*Primary Examiner*—William H. Grieb

*Attorney, Agent, or Firm*—Arthur G. Yeager; Earl L. Tyner

[57] ABSTRACT

A game apparatus comprising an elongated, rod-like rigid member adapted to be affixed to the ground and to project vertically upward therefrom and having a recess at the top end thereof to form a seat for a ball that is attached to said member and removably seated on said recess. This game apparatus is used by throwing ring members at the rod-like member in a manner similar to quoits.

10 Claims, 6 Drawing Figures

GAME APPARATUS

BACKGROUND OF THE INVENTION

The game apparatus of this invention is intended to be employed in a game having some similarities to quoits, but having the additional features including a ball which may be knocked off the top of the stake forming the target for throwing rings. This additional feature adds several dimensions to the scoring, depending upon whether the ball is or is not knocked off the stake during the game. Furthermore, the game of quoits is played with a stake which is only a few inches long, while in the present invention the corresponding stake is intended to be several times longer and to present a target which is at least two feet above the ground level.

It is an object of this invention to provide a novel game apparatus. It is another object of this invention to provide a novel game apparatus that may be employed with ring members that are to be thrown from a distance to contact or encircle the apparatus of this invention. Still other objects will appear from the more detailed description of this invention which follows.

BRIEF SUMMARY OF THE INVENTION

This invention provides a game apparatus comprising an elongated rod-like, rigid member adapted to be affixed to the ground and to project vertically upward therefrom and having a recess at the top end thereof to form a seat for a ball that is attached to said member and removably seated on said recess. In a specific embodiment of this invention the ball is attached to a filament, which in turn, is attached to the rod-like member so that upon pulling of the filament, the ball can be seated in the recess. In another specific embodiment of this invention the vertical rod-like member comprises two disassemblable mating sections and a base plate through which the lower of the two sections can be inserted into the ground to form a stable base for the apparatus, and the upper section can be attached to extend upwardly from the base plate.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
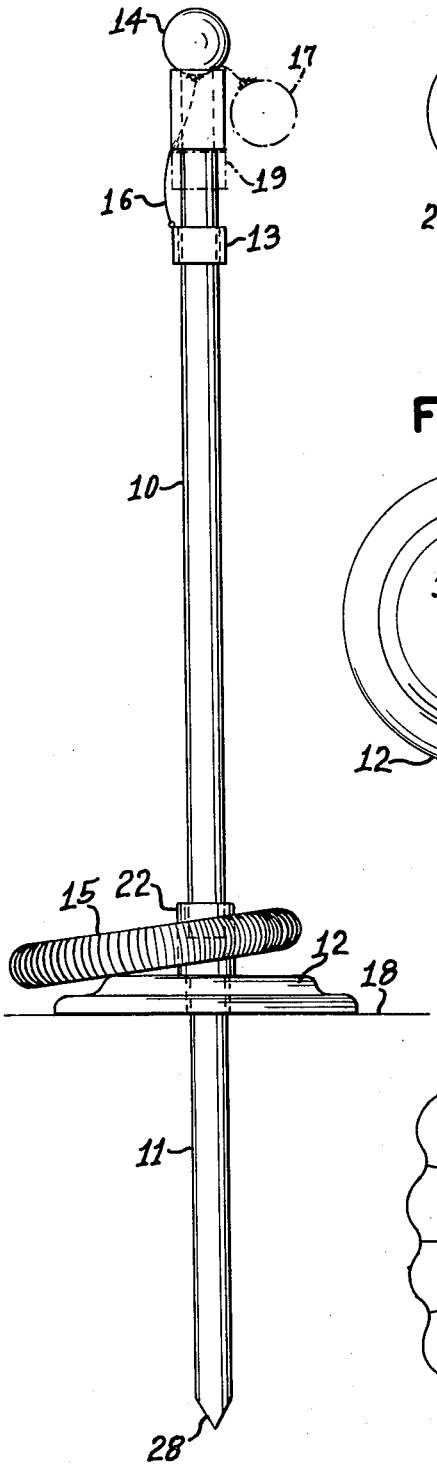
FIG. 1 is an elevational view of the apparatus of this invention in combination with a ring-like throwing member.

In FIG. 1 there may be seen the assembled apparatus of this invention. The apparatus comprises an elongated, rod-like, rigid member which may be a single integral structure or may comprise two separate disassemblable mating sections as shown in this drawing. Upper section 10 and lower section 11 are attached to each other through a coupling 22 to produce a single vertical rod-like member. The sectionalizing of this member permits the structure to be broken down when not in use and stored in a small place. In the apparatus as shown in this drawing lower section 11 is pointed at 28 so that it may be inserted in the ground by pounding or other means to form a stable base for upper section 10. It is preferable to employ a base plate 12 which rests on the earth at ground level 18 with lower section 11 projecting through base plate 12. In this instance lower section 11 has an enlarged collar section 22 at its upper end with the outside diameter of collar section 22 being larger than the passageway through base plate 12 for lower section 11. In this fashion collar 22 will clamp base plate 12 firmly to the top of the ground. If plate 12 is rigid, and sufficiently large in diameter, it will serve as an extremely stable base for the apparatus of this invention. Regardless of its rigidity and size plate 12 is preferably included in this apparatus because it provides an additional scoring feature in the game in which this apparatus is used.

Upper section 10 is designed to fit into coupling 22 by any convenient means of attachment, e.g. tapered socket, threaded connection, untapered friction connection, etc. At the upper end of section 10 there is provided a recess for seating ball 14. In the game employed with this apparatus ball 14 may be knocked out of its seat when ring 15 is thrown from a distance at upper section 10. In order to permit the replacement of ball 14 into its socket quickly after being knocked out of its seat, it is preferred that ball 14 be attached to a funicular structure 16 so as to retain the ball close to its seated position. In such a tethered connection ball 14 would fall to position 17 when knocked off its seat and could be replaced on its seat merely by pulling downwardly on filament 16. In the embodiment shown in this drawing the filament 16 is threaded downwardly from ball 14 through the interior of the recess and the upper end of section 10 and then outwardly through the wall of section 10 to a collar 13 which can slide vertically over the outside of section 10. Collar 13 can slide upwardly to position 19 when ball 14 has been knocked off its seat and falls to position 17. Collar 13 can then be moved downwardly, pulling filament 16 downwardly, to cause ball 17 to regain its seated position at 14. It is to be understood that any other finger gripping means, such as a large ring, or the like, could be used in place of collar 13.

A throwing ring 15 is shown encircling upper section 10 and resting against base plate 12. The apparatus of this invention can be used with one or more rings 15 in different versions of the games that might be employed with this apparatus.

Figure 2:
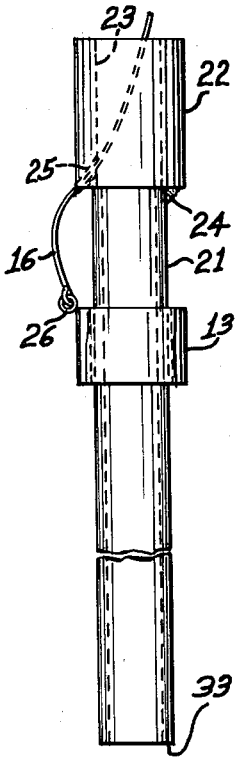
FIG. 2 is an elevational view of the upper section of the apparatus of this invention.

In FIG. 2 there is shown an enlarged view of the preferred embodiment of upper section 10 of this apparatus. The component parts of this apparatus comprise a section of pipe forming the main shaft 21, welded, cemented, or otherwise attached at 24 to a larger pipe section 22 forming a collar at the upper end of shaft 21.

In the case of materials such as copper or thermoplastics, collar 22 may be formed as an integral part on the end of shaft 21 by flaring. The internal diameter 23 of collar 22 functions as a seat for ball 14. In the lower end of collar 22 a passageway 25 communicates the outside of the apparatus with the hollow of pipe 22 so as to permit a filament 16 to freely slide therethrough. Filament 16 may be any of several well known funicular structures, such as a chain, cord, thread, plastic monofilament, twisted yarn, wire, etc. It is only necessary that the filament be sufficiently flexible to pass through passageway 25 and to be attached at one end to ball 14 and at the other end to a finger gripping means for manually pulling on filament 16 to replace ball 14 in its seat at the top of collar 22. A preferred material for this filament is a monofilament of nylon or polyester such as that used for fishing lines. In the embodiment shown in this invention a small section of pipe 13 having an internal diameter slightly larger than the external diameter of main shaft 21 is employed as a sliding collar to which the lower end of filament 16 is attached by means of eye 26 attached to collar 13 by any convenient means, such as cementing, threaded connection, etc. A single connection can be made by drilling or otherwise forming, a small hole through collar 13 and attaching filament 16 thereto by clamping, knotting, or the like.

Figure 3:
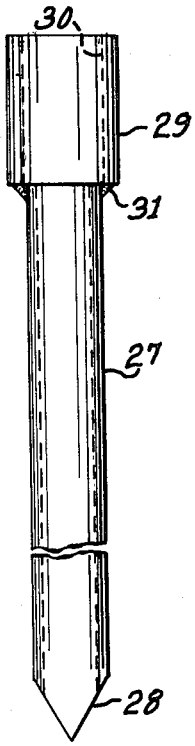
FIG. 3 is an elevational view of the lower section of the apparatus of this invention.

In FIG. 3 there is shown an enlarged view of the preferred embodiment of lower section 11. This section comprises a main shaft 27, preferably made of a pipe to which is attached an enlarged section 29 to form a collar at the upper end thereof. Collar 29 is attached to main shaft 27 by welding, cementing, threaded connection, or the like at 31. Collar 29 may be a larger pipe section as at 22 of FIG. 2 or it may be a solid piece with a recess 30 machined, molded, or otherwise formed therein. It is only necessary that recess 30 be adapted to mate with the bottom portion 33 of shaft 21. If the connection is to be threaded, portion 33 will be externally threaded to mate with internal threads in recess 30. If the connection is to be formed by a tapered joint, portion 33 will be externally tapered while recess 30 will be internally tapered so as to provide mating surfaces for shaft 21 and collar 29. If the connection is to be a friction fitting the relative diameters of portion 33 and recess 30 are made sufficiently close that upper section 10 can be manually attached to lower section 11 by sliding portion 30 into recess 30 to form a tight friction fitting. Whatever type of joint is chosen, it should provide a reasonable rigid connection between main shaft 21 and collar 29 so that upper section 10 does not wobble or vibrate and does provide a firm seat for ball.

Figure 6:
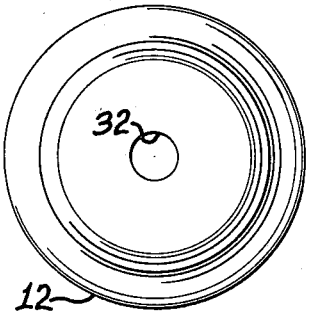
FIG. 6 is an upper plan view of the base plate employed in this invention.

In the instance shown in these drawings shaft 21 is pointed at its lower end 28 so that it may be pounded into the ground to form a stable base for upper section 10. It is preferred to employ a base plate 12 as shown in FIG. 6 having a central bore 32 which is slightly larger than the outside diameter of main shaft 27 so as to permit shaft 27 to be inserted through bore 32 and pounded into the ground causing collar 29 to hold plate 12 tightly against the ground. This requires, of course, that the diameter of bore 32 be less than the outside diameter of collar 29.

Figure 4:
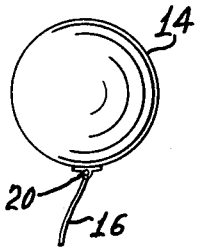
FIG. 4 is an enlarged view of the ball of this apparatus showing its attachment to a filament.

In FIG. 4 it may be seen that ball 14 is preferable fitted with an eye 20 to which filament 16 may be attached. This attachment may be made by cementing, screw threads, or the like. It is immaterial how filament 16 is attached to eye 20, i.e. the filament may be tied with a knot, it may be attached to a swivel means which in turn is attached to eye 20. The filament, after threading through eye 20, may be enlarged or formed with a T-section, or the like.

Figure 5:
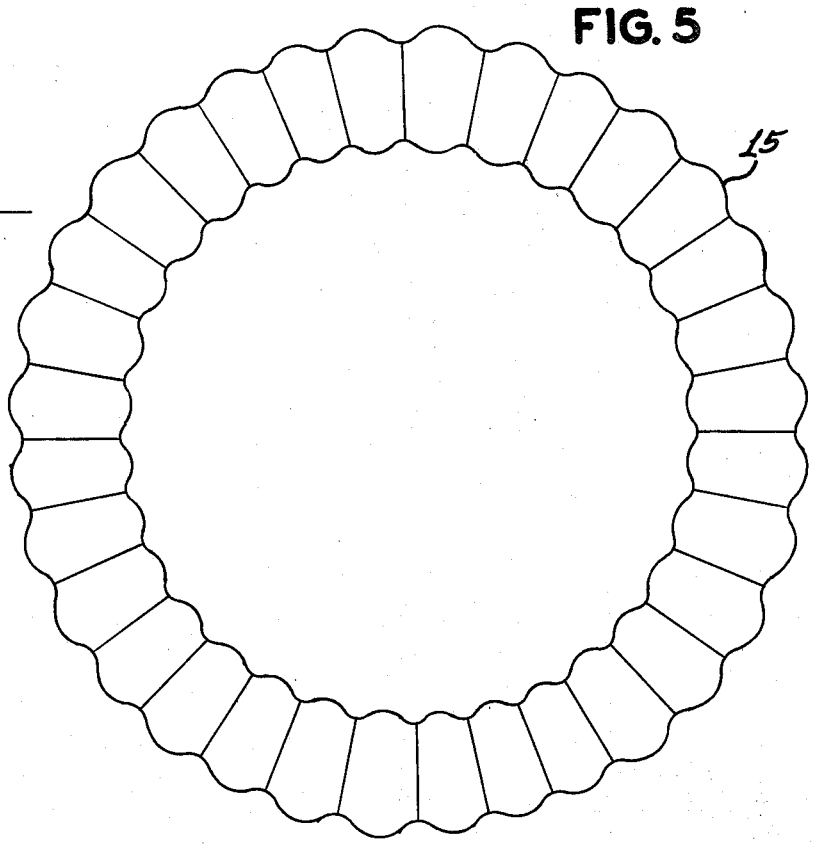
FIG. 5 is a plan view of the throwing ring member of this invention.

In FIG. 5 there is shown a ring member 15 which is employed in combination with the apparatus of this invention for playing the game. Ring 15 is generally thrown from a distance at the apparatus of this invention with the purpose of encircling upper section 10 as shown in FIG. 1 and/or knocking ball 14 off its seat to position 17. The inside diameter of ring 15 is at least twice the diameter of ball 14 and preferably 2–10 times the diameter of ball 14. When ball 14 is a ping-pong ball ring 15 is preferably about 10 inches in inside diameter and about 13 inches in outside diameter.

The component parts of this apparatus may be made of any materials of construction which are convenient, including wood, metal, plastic, etc. In the preferred apparatus upper section 10 and lower section 11 are made of plastic pipe, such as polyvinylchloride pipe. Base plate 12 may be an object commonly known as "Frisbee," when there is no need to add any stability to the apparatus of this invention. However, when stability is needed, e.g. when there is no lower section 11 inserted into the ground, base plate 12 is made of a rigid material, such as metal, and may be made larger in diameter. Ring 15 may be made of rubber or other elastomeric material, a preferred structure being that of ribbed tubing such as the plastic tubing used in swimming pool equipment. Ball 14 may be any type of rubber, wooden, metallic, or other material. A preferred structure is a ping-pong ball to which is attached an eye by means of cementing so as to form the structure of FIG. 4. Filament 16, as has been previously described, is preferably a nylon or polyester monofilament such as used in a fishing line.

It is to be understood that this invention contemplates an apparatus which merely rests on the ground and does not necessarily include lower section 11 which is pounded into the ground. If base plate 12 is made of approximately heavy material such as metal and upper portion 10 is firmly attached thereto, there is no necessity to employ a lower portion 11 inserted into the ground. The general length and diameter of upper section 10 can be varied to suit the desires of those employing this game. it is preferred that the height of ball 14 from ground level 18 be at least about 2 feet so as to provide a target that is more difficult to hit than one closer to the ground. In other embodiments of this invention, e.g. when adults are playing this game, the height of ball 14 above the ground may be 4–6 feet. For the purpose of changing the height of ball 14, there may be additional sections having a lower portion 33 and an upper collar 29 that may be inserted between plate 12 and upper section 10.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to secure by Letters Patent of the United States is:

1. A game apparatus comprising an elongated rod-like rigid member adapted to be affixed to the ground and project vertically upwardly therefrom and having a recess at the top end thereof, a passageway extending from said recess downwardly and outwardly of said member, a collar slideably mounted around the outside of said member, a ball removably seated on said recess, and a filament slideably threaded through said passageway, one end of said filament being attached to said ball and the other end of which being attached to said collar.

2. A game apparatus of claim 1 wherein said member comprises a plurality of sections which can be assembled into a single vertical member.

3. A game apparatus of claim 2 wherein the lower of said sections is adapted to be inserted into the earth to form a stable base for attachement of another section thereto to form said member.

4. A game apparatus of claim 3 which comprises a disc-like base plate adapted to rest on top of the ground with said lower section projecting vertically through said plate.

5. A game apparatus of claim 1 in combination with a throwable ring member having an inside diameter at least twice the diameter of said ball.

6. A game apparatus of claim 1 wherein said recess is the hollow of a pipe section affixed to the upper end of said rod-like member.

7. A game apparatus of claim 1 wherein said member is a pipe.

8. A game apparatus of claim 1 wherein said rod-like member is a pipe and said recess is the hollow of said pipe at the upper end of said member.

9. A game apparatus of claim 1 wherein said member comprises two disassemblable mating sections.

10. A game apparatus of claim 1 which comprises a base plate adapted to rest on the ground and to be attachable to said member.

* * * * *